US006293054B1

(12) United States Patent
Cangialosi

(10) Patent No.: US 6,293,054 B1
(45) Date of Patent: Sep. 25, 2001

(54) GUTTER LINER APPARATUS

(76) Inventor: Sal Cangialosi, 354 Shore Dr., Oakdale, NY (US) 11769

( * ) Notice: Subject to any disclaimer, the term of this patent is extended or adjusted under 35 U.S.C. 154(b) by 0 days.

(21) Appl. No.: 09/390,947

(22) Filed: Sep. 7, 1999

(51) Int. Cl.[7] ..... E04D 13/00
(52) U.S. Cl. ..... 52/12; 210/474
(58) Field of Search ..... 52/12, 302.1, 302.3; 210/164, 163, 473, 474, 477

(56) References Cited

U.S. PATENT DOCUMENTS

| | | | | |
|---|---|---|---|---|
| 956,372 | | 4/1910 | Kreutzberg . | |
| 1,597,503 | * | 8/1926 | Andrews | 52/12 |
| 2,457,940 | | 1/1949 | Swenson . | |
| 2,461,610 | | 2/1949 | Lord . | |
| 2,533,402 | | 12/1950 | Schmitz, Jr. . | |
| 3,507,396 | | 4/1970 | Homa . | |
| 3,550,381 | | 12/1970 | South . | |
| 3,855,132 | | 12/1974 | Dugan . | |
| 4,107,929 | * | 8/1978 | Ebeling et al. | 52/12 X |
| 4,112,691 | | 9/1978 | Ebeling et al. . | |
| 4,406,093 | | 9/1983 | Good et al. . | |
| 4,607,465 | | 8/1986 | Hopkins . | |
| 4,608,786 | * | 9/1986 | Beam | 52/12 X |
| 4,615,153 | | 10/1986 | Carey . | |
| 4,852,308 | | 8/1989 | Papenbrock et al. . | |
| 4,905,427 | | 3/1990 | McPhelan . | |
| 4,949,514 | | 8/1990 | Weller . | |
| 4,964,247 | | 10/1990 | Spica . | |
| 5,103,601 | | 4/1992 | Hunt . | |
| 5,107,635 | | 4/1992 | Carpenter . | |
| 5,109,640 | * | 5/1992 | Creson | 52/12 |
| 5,230,798 | * | 7/1993 | Rogman | 52/12 X |
| 5,409,602 | | 4/1995 | Sorenson . | |
| 5,435,105 | | 7/1995 | Visser . | |
| 5,522,183 | | 6/1996 | Allen . | |
| 5,535,554 | | 7/1996 | Harris, Jr. . | |
| 5,536,406 | | 7/1996 | Silva . | |

* cited by examiner

*Primary Examiner*—Peter M. Cuomo
*Assistant Examiner*—Hanh V. Tran
(74) *Attorney, Agent, or Firm*—Dilworth & Barrese, LLP

(57) ABSTRACT

Gutter liner apparatus having a perforated upper platform surface that extends the width of the gutter and is supported by two sidewalls that extend down from the front and back edges of the upper platform so that the platform is situated in the lower half of the gutter upon installation therein. The perforations in the upper platform surface exclude leaf type debris from blocking the drainage flow of the gutter. The sidewalls can vary from being perpendicular to the upper platform to being flared outwardly away from an axis perpendicular to the upper platform to cause them to bias against the inner surfaces of the gutter. Other geometries provide additional advantages under selected circumstances. Perforations can be only on the upper platform surface or also on the sidewalls.

6 Claims, 3 Drawing Sheets

GUTTER LINER APPARATUS

BACKGROUND

1. Technical Field

The present invention relates to a gutter liner apparatus which excludes leaf and other debris from interrupting the drainage flow in a building's gutter system.

2. Description of Related Art

The accumulation of leaves and other matter in the gutter system of buildings is a constant concern for the building owner. Such accumulation, if not removed leads to interruption of the normal drainage flow that the gutter system was designed to accomplish. If left uncorrected, damage to the gutter system and/or the building may occur.

During periods of rainfall, the run-off water from the roof quickly fills and overflows the clogged gutter system thereby totally defeating the function and purpose of the gutter system. During periods of heavy snow accumulation, the water generated from the accumulated snow which usually melts during daylight hours in direct sunlight fills the clogged gutters only to freeze again at night or when temperatures dip below the freezing point. This cycle which is often repeated for several days can result in what is known as ice damming, wherein the ice fills the gutters completely and if left uncorrected begins to accrete so that it builds up beneath the roofing materials. This can result in serious water damage as the accumulated ice melts underneath the roof and leaks into the attic.

To address this problem, gutter liner apparatuses have been developed which most commonly use different kinds of screening systems to preclude leaves and other debris from accumulating in the bottom of the gutter and blocking the drainage flow. Gutter apparatuses take a wide variety of forms and additional functions such as, for example, U.S. Pat. No. 4,964,247 by Spica which combines a gutter screening and flushing apparatus and U.S. Pat. No. 4,905,427 by McPhalen that forms a roof-rain gutter shield comprising an elongated resilient weatherproof planar sheet.

There is a continuing need which exists for a simple inexpensive gutter liner apparatus that will act as a leaf barrier and be easily installed and replaced.

SUMMARY OF THE INVENTION

The present invention overcomes the aforementioned problems by providing a novel inexpensive gutter liner apparatus that is both easy to manufacture and install. In one embodiment, a gutter liner apparatus is provided which has a perforated upper platform surface that extends the width of the gutter bottom and is supported by two sidewalls that extend downwardly from the edges of the upper platform. Variations in the sidewalls can provide the multiple advantages for the present invention.

Alternate configurations include sidewalls that are perpendicular to the platform portion and rest on the gutter bottom, flare outward and provide a sealing bias against the gutter walls, are connected to form a four sided conduit with a solid bottom, or are connected to form an inverted "V". The perforations can be varied in size and shape to maximize the areas of the through holes or provide a maximum leaf screening effect in instances where smaller leaves predominate. Perforations can also be varied to fit the needs of a particular installation.

An advantage of the invention is that the gutter liner apparatus can be easily installed or removed from a gutter. In one configuration the gutter liner apparatus can be divided into sections approximately three feet in length that allow for the gutter liner apparatus sections to be installed into a gutter from a single point and pushed to their resting point along the gutter bottom without the time consuming placement of individual gutter sections.

In one particular embodiment, the present disclosure provides a gutter liner apparatus including an upper platform surface portion having first and second side edges and defining a plurality of perforations therein, and first and second sidewall portions extending downwardly from the first and second side edges, respectively, the first and second sidewall portions configured and dimensioned such that upon insertion of the gutter liner apparatus in a gutter, the upper platform surface is positioned at a vertical height situated within the lower half of the gutter.

In one aspect of the gutter liner apparatus, at least one of the first and second sidewall portions are disposed orthogonally with respect to the upper platform surface portion.

An alternate feature of the gutter liner apparatus is that the first and second sidewall portions may be flared outwardly away from an axis perpendicular to the first and second side edges such that upon insertion of the gutter liner in a gutter, the first and second sidewall portions bias against the inner surfaces of the gutter.

Additionally, the first sidewall and the second sidewall may also define a plurality of perforations.

A further alternative feature of the gutter liner apparatus is the provision of a lower solid planar platform portion that forms a bottom to the channel section and rests on the bottom of the gutter.

In an alternative embodiment, the gutter liner apparatus includes an elevated platform portion that defines a plurality of perforations, a first sidewall downwardly appending from the rear of the elevated platform portion at a perpendicular angle that rests on the bottom of a gutter when installed therein, and a second sidewall downwardly appending from the front of the elevated portion at a perpendicular angle that rests on the bottom of the gutter when installed therein.

The present disclosure further provides a method of installing a gutter liner apparatus which includes providing a gutter liner apparatus that includes an upper planar surface portion having first and second side edges and defining a plurality of perforations formed therein, and first and second sidewall portions extending downwardly from said first and second side edges, respectively, and resting the gutter liner apparatus on the bottom surface of a gutter such that the upper planar surface is positioned at a vertical height situated within the lower half of the gutter and extends substantially from side to side of the gutter interior.

BRIEF DESCRIPTION OF THE DRAWINGS

The foregoing advantages and features of the presently disclosed gutter liner apparatus will become more readily apparent and may be understood by referring to the following detailed description of illustrative embodiments of the gutter liner apparatus, taken in conjunction with the accompanying drawings, in which.

DETAILED DESCRIPTION OF PREFERRED EMBODIMENT

Figure 1:
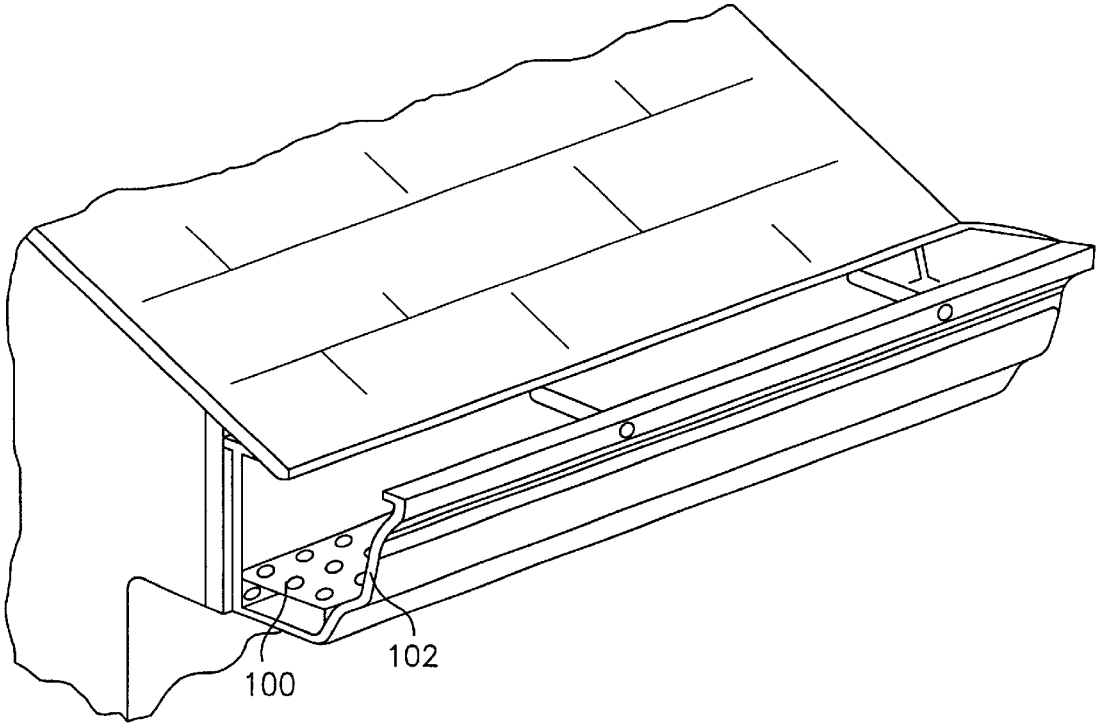
FIG. 1 is an enlarged perspective view of one embodiment of a gutter liner apparatus constructed in accordance with the present disclosure as installed in a gutter.

Referring now to the drawings in detail, and initially to FIG. 1, a gutter liner apparatus designated by reference numeral 100 is shown installed in a gutter 102. In this configuration, gutter liner apparatus 100 rests on the bottom of the gutter and preferably extends less than half way up the height of the gutter.

Figure 2A:
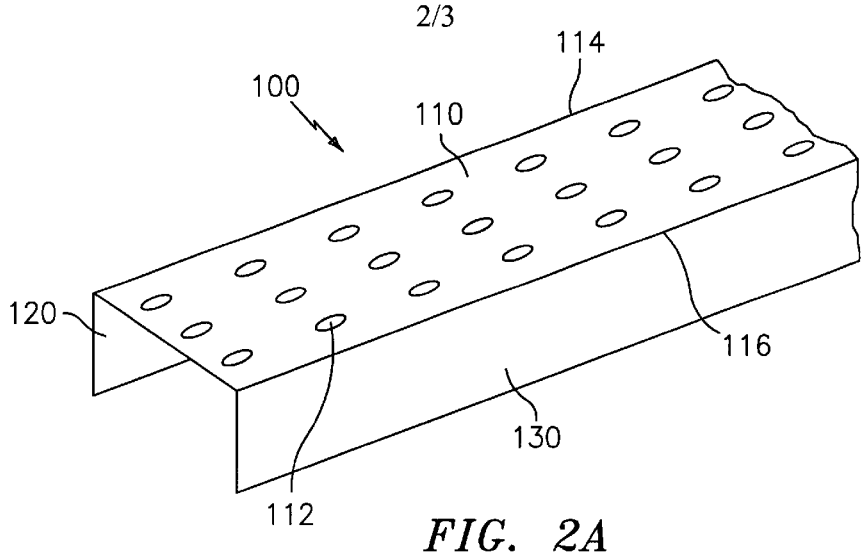
FIG. 2A is a perspective view of an end portion of the gutter liner apparatus embodiment of FIG. 1.

Referring now to FIG. 2A, gutter liner apparatus 100 is formed with an upper platform portion 110 that defines a first edge 114 and second edge 116. A first sidewall 120 extends downwardly from first edge 114 and second sidewall 130 extends from second edge 116. The angles between platform portion 110 and first sidewall 120 and platform portion 110 and second sidewall 130 can vary depending on the specific configuration of gutter liner apparatus. In this configuration, first sidewall 120 and second sidewall 130 are orthogonal to upper platform surface 110.

Gutter liner apparatus 100 has perforations 112 formed in platform portion 110. Perforations 112 formed can vary in frequency, shape, and dimension, but should provide adequate through-holes for the passage of water while excluding leaf type matter. This configuration can provide adequate perforations for the passage of water and exclusion of leaves to maintain a drainage channel for water. The dimensions of the gutter liner apparatus 100 can vary with its intended application in different gutter systems, but one preferred configuration is to form gutter sections approximately 3 feet long, approximately 3 inches deep from the exterior side of the first sidewall to the exterior side of the second sidewall, with approximately ⅝ inch perforations, and approximately ⅝ inch in height. Gutter apparatus 100 can be made from synthetic plastic type materials or metal, but is preferably made from sheet aluminum.

Figure 2B:
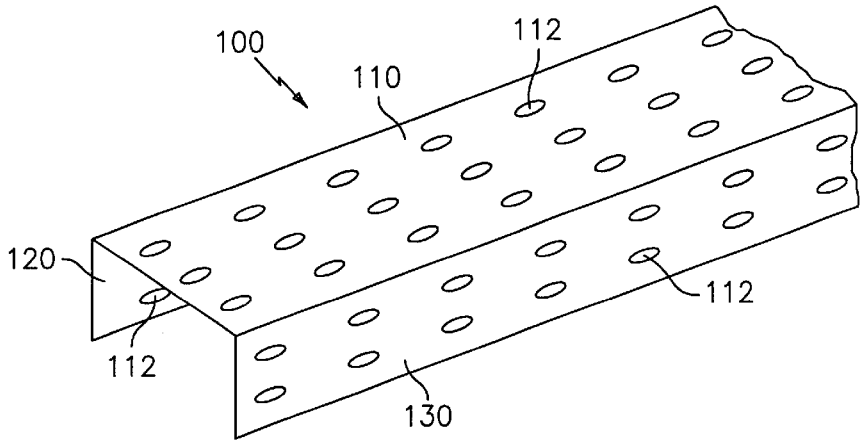
FIG. 2B is a perspective view of a portion of a further embodiment of the presently disclosed gutter liner apparatus with perforations in a platform and sidewall portions.

In FIG. 2B, an alternative configuration is shown wherein gutter liner apparatus 100 has perforations 112 in platform portion 110, first sidewall 120, and second sidewall 130. Through-holes in the first sidewall 120 and second sidewall 130 provide a maximum number of through-holes for the passage of water through the liner apparatus to the bottom of the gutter.

Figure 2C:
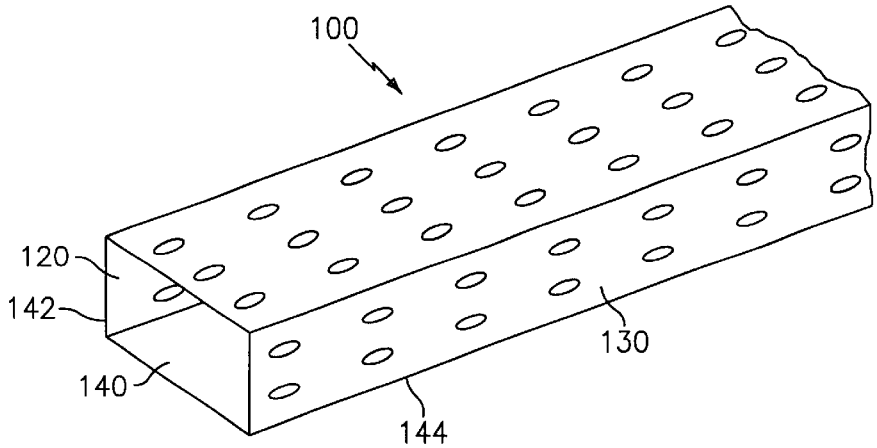
FIG. 2C is a perspective view of a portion of another embodiment of a gutter liner apparatus with a flat planar bottom.

In FIG. 2C, an additional configuration is shown in which gutter liner apparatus 100 has a solid planar bottom portion 140 that extends from the bottom edge 142 of first sidewall 120 to the bottom edge 144 of second sidewall 130. A solid planar bottom portion 140 keeps the gutter free from the majority of the leaf sediment and provides the ability for the sediment that accumulates in the bottom of a gutter to be easily removed with the gutter liner apparatus and cleaned therefrom using water from a garden hose or other similar means.

Figure 3A:
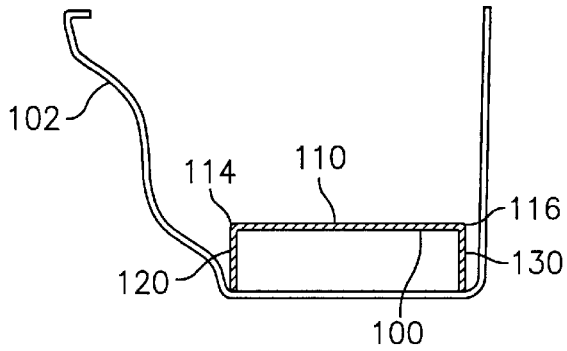
FIG. 3A is a cross-sectional view of the gutter liner apparatus embodiment of FIG. 1 installed within a gutter.

Referring now to FIG. 3A, in use, gutter liner apparatus 100 is installed to rest on the bottom of gutter 102. Upper platform portion 110 defines a flat planar surface between first edge 114 and second edge 116. First sidewall 120 extends down vertically from first edge 114 and second sidewall 130 extends down from second edge 116.

Figure 3B:
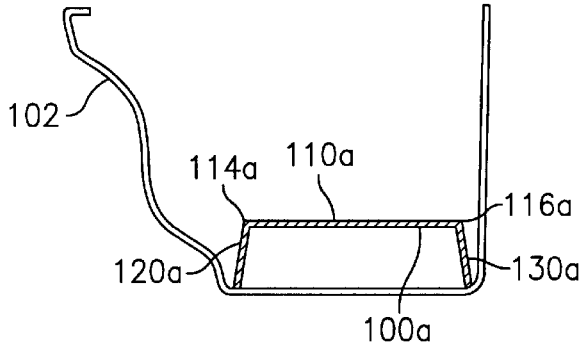
FIG. 3B is a cross-sectional view of a still further embodiment of a gutter liner apparatus having flared sidewalls as installed within a gutter.

In FIG. 3B, gutter liner apparatus 100*a* is shown installed in the bottom of gutter 102. Upper platform portion 110*a* defines a flat planar surface between first edge 114*a* and second edge 116*a*. First sidewall 120*a* and second sidewall 130*a* portions are flared outwardly away from an axis perpendicular to first side edge 114*a* and second side edge 116*a*. As installed, the outward flare of sidewalls 120*a* and 130*a* cause them to bias against the inner surfaces of gutter 102. This outward bias forms a seal against the wall of the gutter which provides an additional barrier level against the intrusion of leaves under the gutter liner apparatus 100*a*.

Figure 3C:
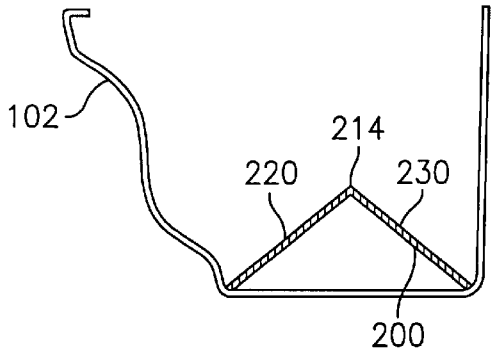
FIG. 3C is a cross-sectional view of yet another embodiment of a gutter liner apparatus with a convex type shape upper platform portion as installed within a gutter.

Referring to FIG. 3C, a further gutter liner apparatus embodiment is shown as gutter liner apparatus 200 with a first sidewall 220 and a second sidewall 230 that both extend downwardly and away from the perpendicular to common first edge 214. This convex type inverted "V" shape form of gutter liner apparatus 200 provides a simple inexpensive leaf and debris barrier with a stand-off that also contains a relatively large perforated surface area for the passage of water. This embodiment could also be formed with a convex cross-sectional shape. This design is intended to have leaves accumulate at the walls of the gutter as they settle so that a center longitudinal passage for water is maintained.

Figure 3D:
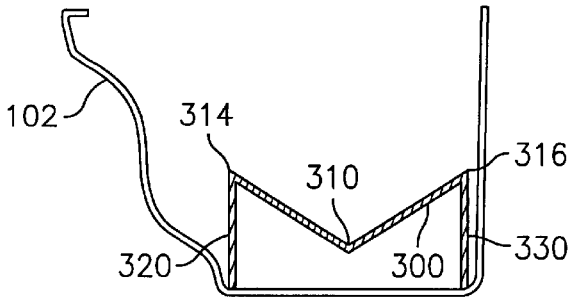
FIG. 3D is a cross-sectional view of a further gutter liner apparatus embodiment with a concave type shape upper platform portion as installed within a gutter.

In FIG. 3D, a further gutter liner apparatus embodiment is shown as gutter liner apparatus 300 installed in bottom of gutter 102. Upper platform portion 310 defines a concave cross-section between first edge 314 and a second edge 316. Other similar forms in this configuration could include a "V" shape or other similar geometric forms that create a concave type upper platform portion 310. A first sidewall 320 extends downwardly from first edge 314 and a second sidewall 330 extends downwardly from second edge 316. These concave type forms allow for the accumulation of leaves in the center of the gutter liner apparatus and allows for the improved passage of the water around the edges. This configuration also allows for an easy removal of the leaves because of their tendency to be collected in the center of the gutter liner apparatus 300.

Although the illustrative embodiments of the present disclosure have been described herein with reference to the accompanying drawings, it is to be understood that the disclosure is not limited to those precise embodiments, and that various other changes and modifications may be affected therein by one skilled in the art without departing from the scope or spirit of the invention. All such changes and modifications are intended to be included within the scope of the appended claims.

What is claimed is:

1. A gutter liner apparatus which comprises:

an upper platform surface portion having first and second side edges and defining a plurality of perforations therein;

first and second sidewall portions extending downwardly from said first and second side edges, respectively, the first and second sidewall portions configured and dimensioned such that upon insertion of the gutter line apparatus in a gutter, the upper platform surface is positioned at a vertical height situated within the lower half of the gutter; and means for sealing the first and second sidewall portions to an inner wall of a gutter.

2. A gutter liner apparatus as recited in claim 1, wherein at least one of the first and second sidewall portions are disposed orthogonally with respect to the upper platform surface portion.

3. A gutter liner apparatus as recited in claim 1, wherein the means for sealing includes flaring the first and second sidewall portions outwardly away from an axis perpendicular to the first and second side edges such that upon insertion of the gutter linear into a gutter, the first and second sidewall portions bias against an inner wall of the gutter.

4. A gutter liner apparatus as recited in claim 1, wherein the first and second sidewall portions define a plurality of perforations.

5. A gutter liner apparatus as recited in claim 1, wherein the first and second sidewall portions form a convex cross-section.

6. A gutter liner apparatus as recited in claim 1, wherein the gutter sections are approximately 3 feet long, approximately 3 inches deep, contain approximately ⅝ inch perforations, and are approximately ⅝ inch in height.

* * * * *